United States Patent [19]

Fast

[11] Patent Number: 4,665,639

[45] Date of Patent: May 19, 1987

[54] DISPLAY TAG FOR PRODUCT INFORMATION

[76] Inventor: Jacob Fast, 7561 NW. 9th St., Plantation, Fla. 33317

[21] Appl. No.: 835,941

[22] Filed: Mar. 4, 1986

[51] Int. Cl.[4] ..... G09F 1/00

[52] U.S. Cl. ..... 40/124.4; 40/19.5; 40/124.1; 40/584; 211/59.1; 248/220.4

[58] Field of Search ..... 40/2 R, 124.1, 124.4, 40/19.5, 584; 206/459; 211/54.1, 57.1, 59.1; 248/220.4, 300

[56] References Cited

U.S. PATENT DOCUMENTS

| | | | |
|---|---|---|---|
| 3,799,357 | 3/1974 | Govang | 206/459 X |
| 3,912,084 | 10/1975 | Valiulis | 248/220.4 X |
| 3,915,294 | 10/1975 | Crosby | 206/459 X |
| 4,247,003 | 1/1981 | Jones | 40/124.1 X |
| 4,394,909 | 7/1983 | Valiulis et al. | 248/220.4 X |
| 4,463,510 | 8/1984 | Windish | 40/2 R X |
| 4,516,681 | 5/1985 | Jahel | 248/220.4 X |
| 4,525,944 | 7/1985 | Fast | 40/124.1 |
| 4,531,313 | 7/1985 | Fast | 40/2 R X |
| 4,583,308 | 4/1986 | Taub | 40/124.4 |

OTHER PUBLICATIONS

Catalogue Extract Fit-All Pricing Corporation.

*Primary Examiner*—Gene Mancene
*Assistant Examiner*—J. Hakomaki
*Attorney, Agent, or Firm*—Holman & Stern

[57] ABSTRACT

A product information display tag is particularly designed for use in combination with a product support hook structure of the gangbar type having elongate support hooks extending forwardly from a transverse bar which in use is support cantilever-wise from a perforated board. The tag has a mounting portion for attachment to the hook structure at a junction of a hook and the bar, and an elongate portion for extending lengthwise over the length of the hook. The mounting portion has a central aperture whereby the tag is slid along the hook from its distal end and the mounting portion is slit into a central tab and outer wing sections. The central tab engages against the front of the gangbar and the outer wing sections are twisted over the back of the bar. Portions of the wing sections are hinged forwardly so that their upper edges snugly grip the bar. The mounting portion provides secure stabilized attachment of the tag to the hook structure. At its forward end, the tab may have tear-away panels so that its effective length can be adjusted.

11 Claims, 4 Drawing Figures

DISPLAY TAG FOR PRODUCT INFORMATION

BACKGROUND OF THE INVENTION

This invention relates to product identification and information display tags for merchandise supsended from horizontally extending support hooks and the like. More particularly, the invention relates to such tags which are easily attached to and removed from support hooks without being subject to inadvertent removal, and which display product information forwardly of the supported merchandise.

I have, in recent years, developed a range of product display tags of the above type for use with different types of support hooks, the tags in general being formed from plastic sheet so as to provide a mounting portion which attaches to a support hook at the back or proximal end of the hook, and an elongate portion which extends forwardly over the support hook (and the products suspended thereon) for presenting product information at the forward or distal end of the support hook. The product information may, for example, be provided on a label secured to a downwardly depending display portion of the tag located forwardly with respect to the distal end of the support hook so that the product information is conveniently displayed to a consumer or the like at a location forwardly of the merchandise. With display tages of this nature, when a product is to be removed from the support hook, the tag may be flexed upwardly and may fall back into position after the product has been released from the hook.

For example, in my prior U.S. Pat. No. 4,525,944, there are disclosed a variety of product display tags having specifically designed mounting portions particularly adapted for securing the tags to forms of support hook structures that attach to perforated boards as commonly used in supermarkets and like stores for displaying suspended products in the form of blister packs and the like. The hook structures referred to in the patent generally comprise individual hooks formed from metal rod and each of which has a support bracket formation at its proximal end whereby the hook is attached to a perforated board individually. The respective display tags have mounting portions designed particularly to be attached to the support bracket formations of the respective hook structures.

Further, in my copending application Ser. No. 792,604 filed Oct. 29, 1985, there is disclosed a form of display tag particularly adapted for use on wire hooks which form part of an integrated, free-standing display unit wherein a hook is attached at its back end to a transverse metal rod. The disclosure of the patent application is specifically incorporated herein by reference.

One form of support hook structure for use on a perforated board which is not specifically referred to in the above-noted patent is a co-called "gangbar" hook structure. A gangbar structure is a relatively simple means for mounting a plurality of spaced support hooks in unison on a perforated board. Thus, the gangbar structure comprises an elongate transverse rod or gangbar with the hooks (which may each comprise a simple one-piece rod) welded to the gangbar adjacent their proximal ends at a spacing between at least two hooks corresponding to the spacing between selected board perforations. The proximal ends of at least the outer hooks of the structure behind the gangbar are bent upwardly. In use, the upwardly bent back ends of the hooks are worked through the respective board perforations from the front of the board, and the gangbar engaged against the front of the board. When released, the back ends of the hooks engaging behind the board and the gangbar engaging against the front of the board serve to support the hook structure from the board in the manner of a cantilever.

The present invention provides a product display tag of the general type previously referred to, and which has a mounting portion specifically designed to attach the tag to a support hook of a gangbar structure as described. The tag, however, is not intended to be limited in its application to a structure of this type, and may also be useful in other situations.

SUMMARY OF THE INVENTION

A display tag in accordance with the invention for use with a gangbar structure as described is formed from sheet material, preferably plastic, with a mounting portion for attachment at a proximal end of the gangbar hook, and an elongate portion for extension lengthwise over the hook from the mounting portion toward the distal end of the hook. The mounting portion may, for example, comprise a fold-down panel connected to the elongate portion of the tag by a transverse fold line formed across the tag. The panel may be divided lengthwise from its terminal transverse edge into a central tab section and a pair of outer wing sections which are themselves foldable longitudinally. The panel may further include a centrally located aperture between the top of the tab and the transverse fold line.

In order to mount the tag on a gangbar hook, which is itself attached to a perforated board as aforesaid, the mounting portion of the tag is folded down and the central aperture therein is placed over the distal end of the hook. The tag is moved along the hook towards its back end and the inner parts of the outer wing sections of the mounting portion are folded back against the outer parts of the wing sections. At the back end of the hook, the folded wing sections are successively twisted over the gangbar and worked down between the bar and the front surface of the board, with the central tab section engaging the front of the hook. The configuration of the wing sections is such that the inner parts can be hinged forwardly and their upper edges, which are preferably concave, tightly gripping the bottom of the gangbar. The mounting portion provides a secure attachment of the tag to the hook structure with good resistance to inadvertent removal and good resistance to side sway of the tag.

At its forward end, the elongate portion of the tag may have attachment means, such as a transverse slit, for a separate detachable display element, as fully disclosed in my copending patent application Ser. No. 719,116, filed Apr. 12, 1985, and the disclosure of which is expressly incorporated herein by reference. The forward end of the elongate portion may also have a lengthwise slot for receipt of the distal end of the support hook.

In accordance with a further feature of the invention, the forward end of the elongate portion of a product display tag of the general type previously referred to may have one or more tear-away panels each formed with attachment means for a separate depending display element as aforesaid, and each of which panels may further have an elongate slot as aforesaid, the leading end of part of the tag behind the tear away panel(s) also having an attachment means for a display element. With this arrangement, the tag may be used at its full length for a long support hook or a tear away panel or panels may be removed for use of the tag with a shorter hook.

Additional features and advantages of the invention will become apparent from the ensuing description and claims read in conjunction with the attached drawings.

DESCRIPTION OF PREFERRED EMBODIMENT

Figures 1, 2, 3, 4:
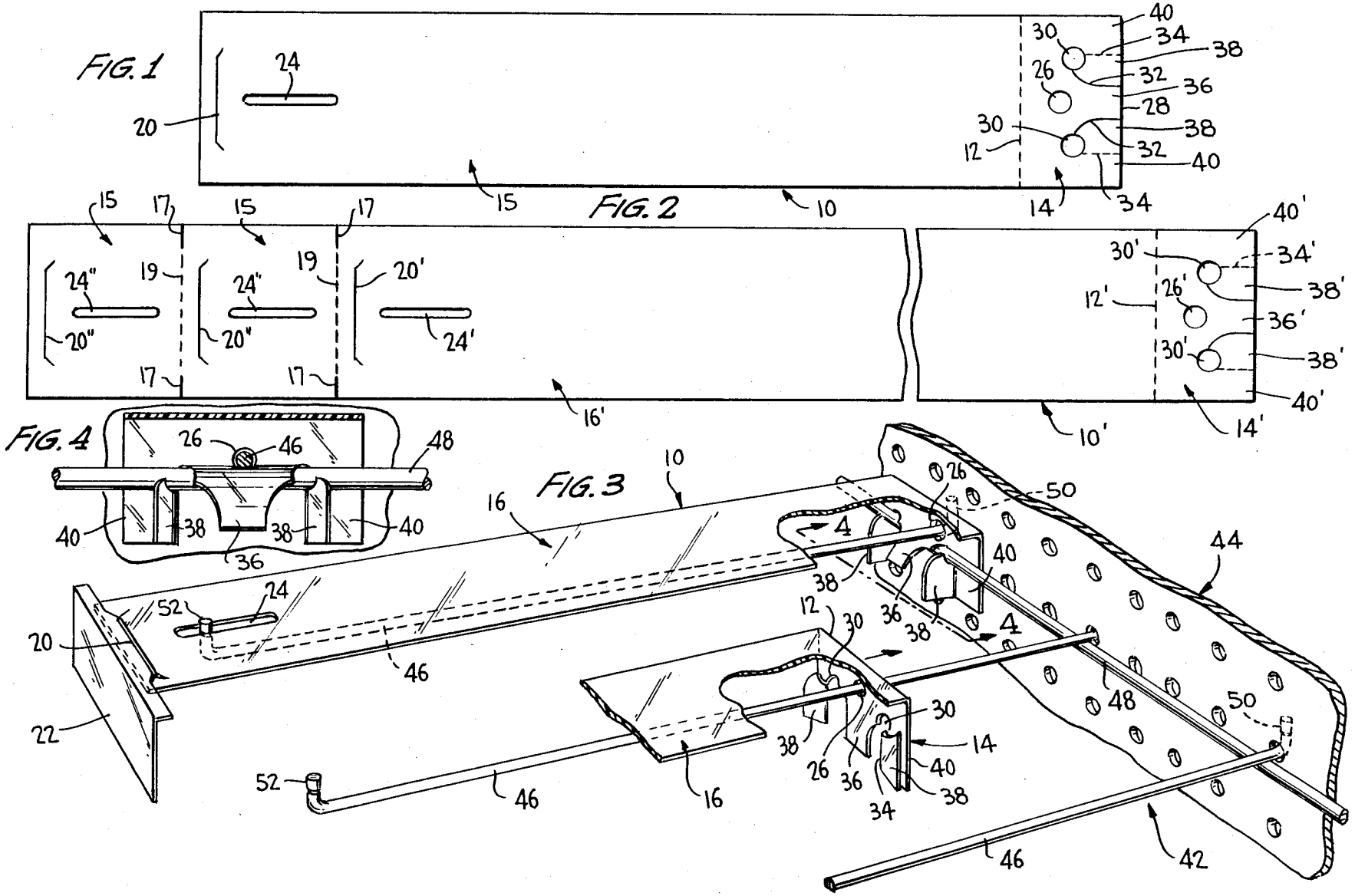
FIG. 1 is a plan view of a blank for forming into a first embodiment product display tag in accordance with the invention.
FIG. 2 is a plan view of a blank for forming into a second embodiment product display tag in accordance with the invention, FIG. 3. is a perspective view showing the manner of attachment of the inventive tags to a gangbar-type hook structure attached to a perforated board.
FIG. 4 is an enlarged sectional view on line 4—4 of FIG. 3.

Referring initially to FIG. 1, there is shown a blank 10 in the form of a die-cut plastic sheet for appropriate folding, as will be described, to form a first embodiment product display tag in accordance with the invention. The blank is formed, inter alia, with a transverse fold line 12 which effectively divides the blank into a first panel 14 for folding to form a mounting portion of the tag, and a substantially longer panel 16 forming an elongate portion of the tag for extending over a product display hook. Adjacent its forward edge 18, panel 16 is provided with a transverse slit 20 forming attachment means for a separate information display element 22 (FIG. 3) as described in detail in the aforementioned copending patent application Ser. No. 719,116. Rearwardly of slit 22, panel 16 is formed with an elongate die-cut slot 24 for receipt of the distal end of a product support hook in a manner which is known per se.

Panel 14 is provided with a first die-cut aperture 26 located on the longitudinal center line of the blank somewhat closer to fold line 12 than to the rear edge 28 of the blank, and a further pair of die-cut apertures 30 spaced rearwardly and outwardly with respect to aperture 26. Extending from the innermost point of each aperture 30 to edge 28 of the blank is a slit 32, the slit being arcuately curved inwardly from the aperture toward the center line of the blank, and then extending substantially linearly to edge 28. Further, the panel is provided with a pair of longitudinal fold lines 34 extending from edge 28 to the respective apertures 30 adjacent the outer edges of the apertures. The apertures 30, slits 32, and fold lines 34 effectively divide panel 14 into a central tab section 36 and outer wing sections each having an inner part 38 and an outer part 40, the inner and outer parts of the respective wing sections being defined by the fold lines 34.

The blank 10 as described above is primarily intended for use as a product display tag in combination with a gangbar hook structure 42 attached to a perforated board 44, as shown in FIG. 3. The gangbar structure comprises a plurality of elongate product support hooks 46 welded adjacent their back or proximal ends to a transverse gangbar 48, the proximal end portions 50 of the outer hooks being bent upwardly behind bar 48. The forward end portions 52 of the hooks may also be bent upwardly, and at least the outer hooks are spaced along the gangbar at distances corresponding to the spacing between selected perforations of board 44. The gangbar structure is attached cantilever-wise to the board by working end portions 50 of the outer hooks through the relevant perforations in the board from the front and engaging the gangbar against the front face of the board.

In order to attach blank 10 to one of the support hooks 46 to provide a product information display tag, panel 14 is folded down about line 12 substantially perpendicularly to panel 16, and inner parts 38 of the wing sections or folded back about fold lines 34 toward the inner surfaces of the outer parts 40, as seen most clearly in the tag shown on the central hook of FIG. 3. Aperture 26 is threaded onto the distal end of one of the hooks 46 and the tag is slid along the hook to the gangbar. The respective wing sections of the panel 14 in their folded state are sequentially twisted over the back of the gangbar and pressed down between the gangbar and the front surface of board 44 while the central tab section 36 remains in engagement with the front of bar 48. Then, inner parts 38 of the wing sections are hinged forwardly about fold lines 34 to the position shown at the top of FIG. 3 and in FIG. 4. It will be understood taht the spacing between aperture 26 and the respective apertures 30, as well as the general configuration of panel 14 is such that when parts 38 are hinged forwardly, their curved concave edges (originally quadrants of apertures 30) snugly grip the gangbar 48 and snap into place. In this mounted condition of the tag (see particularly FIG. 4) the material defining the circumference of each of the original apertures 30 has been distorted or twisted helically around the gangbar thereby firmly gripping the bar. This gripping engagement of the mounting portion of the tag around the gangbar on both sides of the support hook effectively stabilizes the tag inhibiting its inadvertent removal and providing good resistance to side away of portion 16. To remove the tag, the above-described mounting procedure may be reversed. Product information may be provided by a label or the like on element 22, and if a change of information is required, the label or the element as a whole can be replaced.

Blank 10' shown in FIG. 2 is substantially similar to blank 10 having a substantially identical panel 14' providing the mounting portion, and a substantially identical elongate panel 16' with transverse attachment slit 20' and slot 24' (the dimensions of the blanks could be different.) Blank 10', however, has at its forward end tear-away panels 15. Two tear-away panels are shown in FIG. 2, but the number can be varied. Each tear-away panel is defined by a perforated or like transverse crease 19 with cut slits or notches 17 at its ends. Further, each tear-away panel has a transverse slit 20'' which is a replica of slit 20', and a longitudinal slot 24'' which is a replica of slot 24'.

It will be readily understood that the purpose of the tear-away panels is to provide a tag of selectively variable length to suit different length support hooks. Thus, at its full length the tag can be used on a relatively long hook, and for shorter hooks, one or more of the tear-away panels can be removed. Moreover, the tear-away panels can also be provided on information display tags which have mounting portions of different form to the mounting portions 14, 14' disclosed herein.

While only preferred embodiments of the invention have been described herein in detail, the invention is not limited thereby and modifications can be made within the scope of the attached claims.

I claim:

1. An elongate substantially rectangular blank of sheet material for folding into a product information display tag for use in combination with an elongate product support hook, the blank comprising a shorter panel and a longer panel which panels are interconnected by a fold line extending transversely across the blank, the shorter panel including a first aperture located substantially on a longitudinal center line of the blank between said fold line and a transverse edge of the panel defining one end of the blank, a pair of further apertures located on opposite sides of the longitudinal center line respectively between the first aperture and said one end of the blank, and a slit extending from an inboard point on the circumference of each of said further apertures to said one end of the blank for allowing a part of the shorter panel outwardly of the slit to be folded about a longitudinal line extending between said one end of the blank and an outboard point on the circumference of the respective further aperture.

2. The invention as defined in claim 1 wherein the shorter panel is formed with fold lines defining the respective longitudinal lines.

3. The invention as defined in claim 1 wherein the further apertures are circular and the inboard points are the innermost points on the respective circumferences thereof.

4. The invention as defined in claim 1 wherein each slit has an arcuate portion extending inwardly toward the longitudinal center line of the blank from the respective inboard point, and a substantially linear portion extending from the arcuate portion to said one end of the blank.

5. The invention as defined in claim 1 wherein the blank has attachment means adjacent its opposite end for a separate display element.

6. The invention as defined in claim 5 wherein said attachment means is formed on a tear-away panel portion of the blank, the blank having a transverse tear-line defining said tear-away portion and further attachment means for a separate display element adjacent the tear-away portion.

7. The invention as defined in claim 6 wherein the tear-away portion and further attachment means are replicated lengthwise of the blank with a further transverse tear-line extending between the tear-away portions.

8. An information display tag for use in combination with a product support hook structure having an elongate hook extending forwardly from a transverse bar supported cantilever-wise from a perforated board or the like, the tag comprising an elongate rectangular sheet having a mounting portion for securing the tag to the structure substantially at a junction between the bar and hook, and an elongate portion longer than the mounting portion for extension over the length of the hook, the mounting portion comprising a fold-down panel at one end of the sheet connected to the elongate portion by a transverse fold line, the panel including a substantially centrally located aperture for sliding along the hook from a distal end of the hook, the panel further including slits defining a central tab section below the aperture for engagement against the front of said bar and outer longitudinally foldable wing sections adjacent the tab section for twisting behind the bar between the bar and the board and for forward hinging of folded inner parts of the wing sections so that upper edge portions thereof snugly grip the bar in a manner stabilizing the tag.

9. The invention as defined in claim 8 wherein the panel includes a pair of further apertures located outwardly and below the centrally located aperture, the slits extending from inboard points on the circumberences of the respective further apertures, each slit including an arcuate portion extending from the respective inboard point and a substantially linear portion extending from the arcuate portion to a free end of the panel, the material of the panel defining the circumferences of the respective further apertures in use being twisted helically around said bar whereby the mounting portion grips the bar.

10. The invention as defined in claim 9 wherein said panel further includes fold lines extending from said free end to outboard points on the circumferences of the further apertures to facilitate folding and hinging of said parts of the wing sections as aforesaid.

11. The invention as defined in claim 8 wherein said sheet has at least one tear-away panel at an end of the elongate portion remote from the mounting portion, the tear-away panel being connected to the elongate portion by a transverse tear line, the elongate portion having first attachment means for a separate display element adjacent the tear line, and the tear-away panel having second attachment means for a separate display element adjacent a free end thereof.

* * * * *